US007073467B2

(12) United States Patent
Kanno et al.

(10) Patent No.: US 7,073,467 B2
(45) Date of Patent: Jul. 11, 2006

(54) COOLING WATER CIRCUIT SYSTEM

(75) Inventors: Tatsuya Kanno, Kariya (JP); Nobuyuki Uozumi, Kariya (JP); Michiya Takatsuka, Obu (JP)

(73) Assignee: DENSO Corporation, Kariya (JP)

( * ) Notice: Subject to any disclaimer, the term of this patent is extended or adjusted under 35 U.S.C. 154(b) by 0 days.

(21) Appl. No.: 10/953,692

(22) Filed: Sep. 29, 2004

(65) Prior Publication Data

US 2005/0072385 A1 Apr. 7, 2005

(30) Foreign Application Priority Data

Oct. 7, 2003 (JP) ..... 2003-348679

(51) Int. Cl.
*F01P 11/08* (2006.01)

(52) U.S. Cl. ..... 123/41.33

(58) Field of Classification Search ..... 123/41.33, 123/41.58, 41.01
See application file for complete search history.

(56) References Cited

U.S. PATENT DOCUMENTS

| | | | |
|---|---|---|---|
| 2,670,933 A | 3/1954 | Bay | |
| 4,520,767 A | 6/1985 | Roettgen et al. | |
| 5,960,872 A | 10/1999 | Huemer et al. | |
| 6,053,131 A | 4/2000 | Mueller et al. | |
| 6,098,576 A | 8/2000 | Nowak, Jr. et al. | |
| 6,530,347 B1 * | 3/2003 | Takahashi et al. | 123/41.1 |

FOREIGN PATENT DOCUMENTS

| | | |
|---|---|---|
| JP | 6-257430 | 9/1994 |
| JP | 2002-47935 | 2/2002 |

OTHER PUBLICATIONS

Tom Ryrie et al: "Engine/Transmission Cooling System" Research Disclosure, Kenneth Mason Publications, Hampshire, GB, vol. 377, No. 11, Sep. 1995, XP007120575; ISSN: 0374-4353.
Search/Examination Report dated Jan. 12, 2005 in EP Appln. No. 04 02 3692.

* cited by examiner

*Primary Examiner*—Tony M. Argenbright
*Assistant Examiner*—Katrina Harris
(74) *Attorney, Agent, or Firm*—Harness, Dickey & Pierce, PLC

(57) ABSTRACT

A cooling water circuit system for an engine includes a radiator bypass passage through which cooling water of the engine bypasses a radiator, a heat exchanger disposed in the radiator bypass circuit to perform heat exchange between the cooling water and lubricant oil of an automatic transmission, and a radiator downstream passage through which the cooling water from the radiator flows into the heat exchanger. Further, a flow adjusting unit is disposed at a join portion where the radiator bypass passage and the radiator downstream passage are joined, to adjust a flow ratio between the cooling water flowing from the radiator downstream passage to the heat exchanger and the cooling water flowing from the radiator bypass passage to the heat exchanger. The flow adjusting unit is controlled by a control unit in accordance with the temperature detected by the temperature detection unit.

11 Claims, 3 Drawing Sheets

COOLING WATER CIRCUIT SYSTEM

CROSS REFERENCE TO RELATED APPLICATION

This application is based on Japanese Patent Application No. 2003-348679 filed on Oct. 7, 2003, the disclosure of which is incorporated herein by reference.

FIELD OF THE INVENTION

The present invention relates to a cooling water circuit system of a vehicle engine, which is suitably used for heating and cooling lubricant oil of an automatic transmission mounted on a vehicle.

BACKGROUND OF THE INVENTION

An oil heat exchanger in which lubricant oil of an automatic transmission flows is specially provided in a conventional cooling water circuit in which engine-cooling water flows when a thermostat is closed (e.g., JP-A-2002-47935). The heat exchanger performs heat exchange between the lubricant oil and engine-cooling water, so as to heat the lubricant oil in a warming-up operation after the vehicle engine starts, and to cool the lubricant oil in an engine normal operation. However, in this heat exchanger, because the lubricant oil is heated by using cooling water (hot water) in a heater water circuit to sufficiently heat the lubricant oil in the warming-up operation, the lubricant oil may be not sufficiently cooled in the engine normal operation sometimes. Conversely, when cooling water after passing through a radiator is used in the heat exchanger for sufficiently cooling the lubricant oil, warming-up performance of the lubricant oil after the engine start may be deteriorated.

SUMMARY OF THE INVENTION

In view of the above-described problems, it is an object of the present invention to provide a cooling water circuit system for a vehicle engine, which can suitably adjust a temperature of lubricant oil of an automatic transmission based on detected temperature of the lubricant oil.

It is another object of the present invention to provide a cooling water circuit system, which sufficiently cools lubricant oil of an automatic transmission in an engine normal operation, while rapidly heating the lubricant oil when the temperature of the lubricant oil is lower than a set temperature after the engine starts.

According to the present invention, a cooling water circuit system for an engine includes a radiator which cools cooling water of the engine, a radiator water passage through which cooling water circulates between the radiator and the engine, a radiator bypass passage through which the cooling water from the engine bypasses the radiator, a heat exchanger disposed in the radiator bypass circuit to perform heat exchange between the cooling water and lubricant oil of an automatic transmission of the engine, and a radiator downstream passage through which the cooling water after passing through the radiator flows into the heat exchanger. The radiator downstream passage is connected to the radiator water passage at a downstream side of the radiator and an upstream side of the heat exchanger. In the cooling water circuit system, a flow adjusting unit is disposed at a join portion where the radiator bypass passage and the radiator downstream passage are joined, to adjust a flow ratio of the cooling water flowing from the radiator downstream passage to the heat exchanger to the cooling water flowing from the radiator bypass passage to the heat exchanger. Furthermore, a temperature detection unit detects a temperature of the lubricant oil having passed through the heat exchanger, and a control unit controls the flow adjusting unit in accordance with the temperature detected by the temperature detection unit. Accordingly, when the temperature is lower than a set temperature in a warming-up operation of the engine, a flow amount of the cooling water flowing from the radiator bypass passage is increased by the flow adjusting unit so that the lubricant oil can be early heated. In contrast, when the temperature of the lubricant oil is higher than an upper limit temperature in a normal operation or a high-load operation of the engine, a flow amount of the cooling water flowing from the radiator downstream passage is increased so that the lubricant oil can be sufficiently cooled. As a result, the cooling water circuit system sufficiently cools the lubricant oil of the automatic transmission in the engine normal operation or in the high-load operation of the engine, while rapidly heating the lubricant oil when the temperature of the lubricant oil is lower than the set temperature after the engine starts.

Further, it is possible to shut a flow of the cooling water from the radiator downstream passage to the heat exchanger when the temperature detected by the temperature detection unit is lower than the set temperature after the engine starts. In addition, it is possible to shut a flow of the cooling water from the radiator bypass passage to the heat exchanger when the temperature detected by the temperature detection unit is higher than the upper limit temperature that is generally higher than the set temperature by a predetermined temperature.

Preferably, a heat-exchanger bypass passage is connected to the flow adjusting unit such that the cooling water from the flow adjusting unit bypasses the heat exchanger through the heat-exchanger bypass passage. Therefore, the flow adjusting unit can suitably adjust the flow ratio without decreasing an original flow amount of the radiator bypass passage or the radiator downstream passage while having a simple structure. For example, the flow adjusting unit is a four-way valve. In this case, the four-way valve has a first opening portion connected to a downstream end side of the radiator downstream passage, a second opening portion connected to an upstream end side of the heat-exchanger bypass passage, and third and fourth opening portions connected to the radiator bypass passage at upstream and downstream sides of the four-way valve.

In the present invention, the radiator bypass passage can include a heater water passage having therein a heater core which heats a fluid using the cooling water as a heating source. More preferably, the radiator bypass passage further includes a heater-core bypass passage through which the cooling water bypasses the heater core in the radiator bypass passage.

Alternatively, the radiator bypass passage includes a main bypass passage through which the cooling water bypasses the radiator, and a branch passage branched from the main bypass passage such that cooling water introduced from the main bypass passage to the branch passage returns to the engine after passing through the heat exchanger.

BRIEF DESCRIPTION OF THE DRAWINGS

Other objects, features and advantages of the present invention will become more apparent from the following detailed description made with reference to the accompanying drawings, in which.

Figure 1:
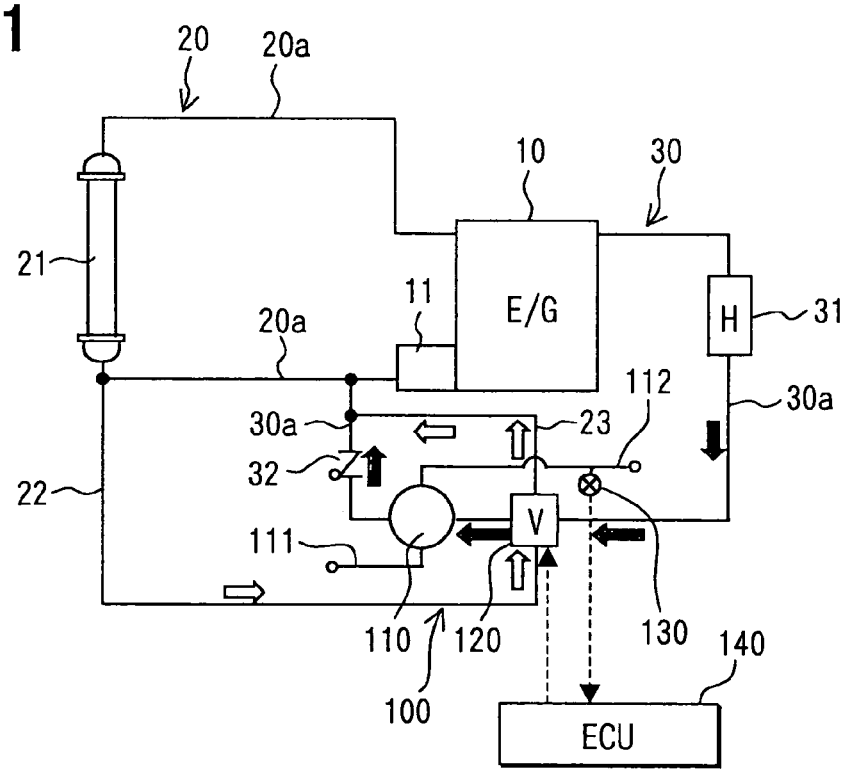
FIG. 1 is a schematic diagram of a cooling water circuit system showing a flow of cooling water at a time immediately after an engine start, according to a first embodiment of the present invention.

DETAILED DESCRIPTION OF THE PREFERRED EMBODIMENTS (First Embodiment)

The first embodiment of the present invention will be now described with reference to FIGS. 1–3. A vehicle engine 10 is provided in a cooling water circuit system in which cooling water (coolant) for cooling the vehicle engine 10 flows. The vehicle engine 10 includes an automatic transmission (not shown) that is provided with a torque converter for operating a clutch and various gears for transmissions. Lubricant oil (ATF) is used in the torque converter as a power transmission medium. A cooling water circuit 100 is provided for rapidly increasing the temperature of the lubricant oil when the temperature of the lubricant oil is lower than a set temperature after an engine start, and for cooling the lubricant oil at a suitable temperature in an engine normal operation.

The cooling water circuit system of the engine 10 includes a radiator water circuit 20 for adjusting the temperature of the engine 10 at a suitable temperature. The radiator water circuit 20 includes a radiator water passage 20*a* and a radiator 21 disposed in the radiator water passage 20*a*. In the radiator water circuit 20, cooling water in the engine 10 is circulated to the radiator 21 by operation of a water pump 11. A thermostat (not shown) is provided at an upstream side of the radiator 21 in the radiator water passage 20*a*. The cooling water circuit system of the engine 10 further includes a heater water circuit 30 that has a heater core 31 provided in a heater water passage 30*a* through which cooling water flowing from the engine 10 returns to the water pump 11 while bypassing the radiator 21. The heater core 31 is a heating heat exchanger which heats air to be blown into a vehicle compartment using the engine-cooling water (hot water) as a heating source. In this embodiment, because a flow amount adjusting means such as a valve is not provided in the heater water circuit 30, cooling water in the engine 10 is always circulated by the water pump 11 between the engine 10 and the heater core 31. For example, when the thermostat (not shown) provided in the radiator passage 20 closes, the cooling water in the engine 10 only flows to the heater water circuit 30. Here, the heater water circuit 30 is a radiator bypass passage through which the cooling water of the engine 10 bypasses the radiator 21.

An oil cooler 110 is provided in the heater water circuit 30 between the heater core 31 and the water pump 11. The oil cooler 110 is a heat exchanger for heating (warming-up) and cooling the lubricant oil of the automatic transmission. As the oil cooler 110, a round laminated-type heat exchanger made of aluminum can be used. For example, plural round plates having plural opening portions can be laminated, and the openings of the plural round plates communicate with each other, so that a cooling water flowing portion and an oil flow portion are formed in the oil cooler 110. The heater water passage 30*a* is connected to the cooling water flowing portion of the oil cooler 110. Furthermore, an oil inlet pipe 111 and an oil outlet pipe 112 provided in the automatic transmission are connected to the oil flowing portion of the oil cooler 110. Therefore, the cooling water flows through the cooling water flowing portion of the oil cooler 110 and the lubricant oil flows through the oil flowing portion of the oil cooler 110 so that the cooling water and the lubricant oil cooler 110 so that the cooling water and the lubricant oil perform heat exchange therebetween in the oil cooler 110.

As the oil cooler 110, the other types can be used without being limited to the round laminated type. For example, an oil unit can be accommodated in a round or angle shaped body member to form the oil cooler. Alternatively, a multiple-pipe heat exchanger, which is constructed with different-diameter cylindrical members arranged coaxially, can be used as the oil cooler 110.

A temperature sensor 130 (temperature detecting unit 130 is disposed in the oil outlet pipe 112, for detecting the temperature of the lubricant oil after passing through the oil cooler 110. The oil temperature detected by the temperature sensor 130 is output to a control unit 140 (ECU) which will be described later.

A radiator downstream passage 22, through which cooling water after passing through the radiator 21 flows toward the oil cooler 110, is connected to an upstream side position of the oil cooler 110 and to a downstream side position of the radiator 21 in the radiator water circuit 20. Furthermore, a four-way valve 120 is provided in a join portion at which the radiator downstream passage 22 and the heater water passage 30*a* are connected.

The four-way valve 120 is a port-type valve which has four opening portions at exterior sides and is capable of varying communication states of the four opening portions by operation of a valve mechanism. The operation of the four-way valve 120 is controlled by the control unit 140. The heater water passage 30*a* is connected to two opening portions of the four-way valve 120, the radiator downstream passage 22 is connected to a one opening portion of the four-way valve 120, and a bypass passage 23 is connected to the other one opening portion of the four-way valve 120, among the four opening portions of the four-way valve 120.

The bypass passage 23 connected to the four-way valve 120 is joined to the heater water passage 30*a* at a downstream side of the oil cooler 110 so that cooling water from the four-way valve 120 bypasses the oil cooler 110 through the bypass passage 23. A check valve 32 is provided between the oil cooler 110 and a join portion at which the bypass passage 23 is joined to the heater water passage 30*a*, so as to allow a flow of cooling water from the oil cooler 110 to the water pump 11 and to prevent a reverse flow. That is, the check valve 32 is provided to prevent a flow of cooling water from the bypass passage 23 toward the oil cooler 110.

The control unit 140 (ECU) controls the operation of the four-way valve 120 based on a temperature signal from the temperature sensor 130. Specifically, the control unit 140 is provided with determination temperatures such as a set temperature T(SET) for early increasing the temperature of the lubricant oil in a warming-up operation after the engine start, and an upper limit temperature T(UP) of lubricant oil admitted in an engine normal operation. Furthermore, the control unit 140 compares the detected actual temperature and the determination temperature, and controls the communication sates between the four opening portions of the four-way valve 120.

Next, operation of the cooling water circuit system of the present invention will be now described with reference to the time chart of FIG. 3.

At a time immediately after the engine 10 starts, the temperature of the lubricant oil is generally lower than the set temperature T(SET). While the temperature of the lubricant oil is lower than the set temperature T(SET) (e.g., 80° C.), the control unit 140 controls the communication state of the opening portions of the four-way valves 120 so that the cooling water in the heater water passage 30*a* flows into the oil cooler 110 as shown by the block arrow in FIG. 1 and cooling water in the radiator downstream passage 22 flows toward the bypass passage 23 as shown by the white arrow in FIG. 1.

When the temperature of the lubricant oil is lower than the set temperature T(SET) (e.g., 80° C.), the thermostat in the radiator water passage 20*a* is closed so that the cooling water in the engine 10 flows in the heater core 30*a* without flowing to the radiator 21. That is, in a time period t1, the operation of the four-way valve 120 is controlled so that cooling water only from the heater water passage 30*a* (radiator bypass passage) flows into the oil cooler 110 through the four-way valve 120. Therefore, lubricant oil having a low temperature is heat-exchanged with the cooling water from the heater water passage 30*a* in the oil cooler 110, and the temperature of the lubricant oil is rapidly increased by using the cooling water having a temperature that increases in accordance with the warming-up operation of the engine 10.

When the thermostat of the radiator water passage 20*a* is opened in accordance with a temperature increase of the cooling water of the engine 10, the cooling water also flows to the radiator water passage 20*a*. That is, in a time period t2 in FIG. 3, both the cooling water from the heater core 31 and the cooling water from the radiator 21 can flow into the oil cooler 110. In this embodiment, a part of cooling water having a low temperature from the radiator downstream passage 22, after passing through the radiator 21, can flow into the bypass passage 23 through the four-way valve 120 in accordance with a detected temperature of the lubricant oil. The cooling water flowing into the bypass passage 23 is joined to the heater water passage 30*a* at a downstream side of the oil cooler 110 and returns to the engine 10. Hear, because the check valve 32 is provided, the cooling water having passed through the bypass passage 23 does not flow to the oil cooler 110.

Figure 2:
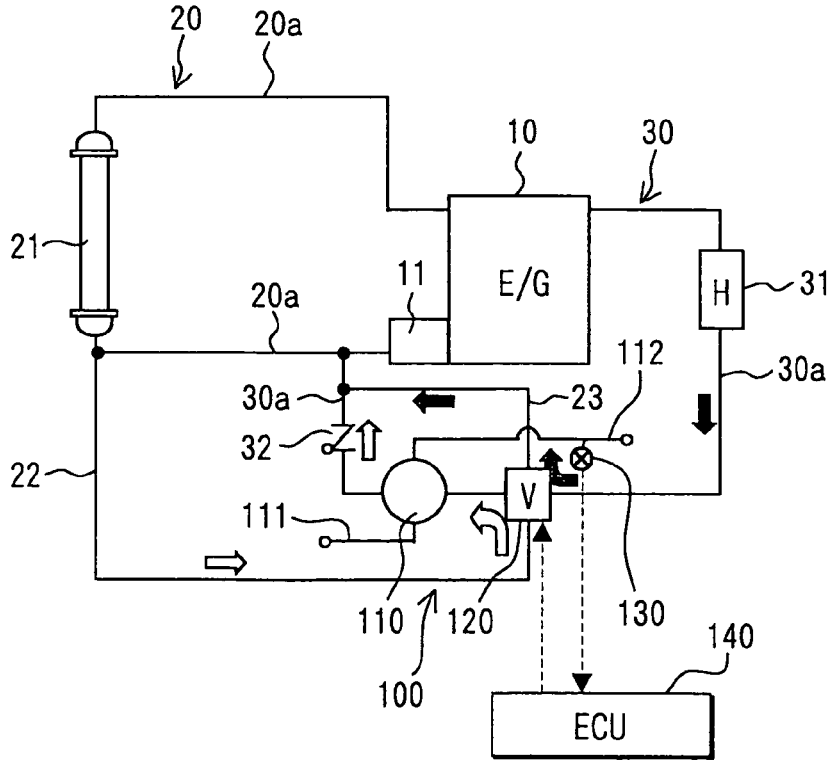
FIG. 2 is a schematic diagram of the cooling water circuit system showing a flow of cooling water in an engine normal operation, according to the first embodiment.
Figure 3:
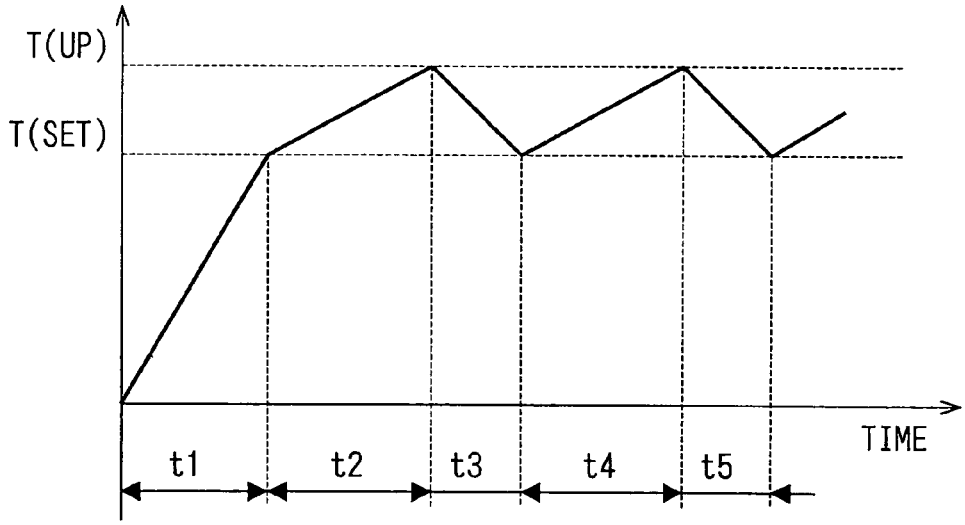
FIG. 3 is a time chart showing a temperature change of lubricant oil in accordance with switching operation of a cooling water flow, according to the first embodiment.

When the normal operation of the engine 10 is performed after the temperature of the lubricant oil becomes higher than the set temperature T(SET), or when the temperature of the lubricant oil becomes higher than the upper limit temperature T(UP), the communication state of the opening portions of the four-way valve 120 is changed so that the cooling water of the heater water passage 30*a* flows into the bypass passage 23 as shown by the black arrow in FIG. 2 and the cooling water of the radiator downstream passage 22 flows to the oil cooler 110 as shown by the white arrow in FIG. 2. For example, in a time period t3 of FIG. 3, only the cooling water from the radiator 21 flows into the oil cooler 110 while the cooling water from the heater core 31 bypasses the oil cooler 110 through the bypass passage 23. In this case, at least a part of the cooling water after passing through the radiator 21 flows from the radiator downstream passage 22 into the oil cooler 110 through the four-way valve 120. Therefore, a temperature difference between the lubricant oil and the cooling water in the oil cooler 110 can be enlarged when the temperature of the lubricant oil is higher than the upper limit temperature, and the lubricant oil can be effectively cooled.

When the detected temperature of the lubricant oil is in the range between the set temperature T(SET) and the upper limit temperature T(UP) in the normal operation of the engine 10 (e.g., the time period t4 in FIG. 3), the control unit 140 controls the operation position of the four-way valve 120 to be set at a middle position between the position shown in FIG. 1 and the position shown in FIG. 2. In this case, the cooling water from the heater water passage 30*a* and the cooling water from the radiator downstream passage 22 flow into the oil cooler 110 through the four-way valve 120 after being mixed. Therefore, the lubricant oil can be cooled at a suitable temperature in the normal operation of the engine 10.

Further, when the temperature of the lubricant oil is increased equal to or higher than the upper limit temperature T(UP) (e.g., the time period t5), a flow amount of the cooling water flowing from the radiator downstream passage 22 to the oil cooler 110 can be increased or only the cooling water flowing from the radiator downstream passage 22 can be supplied to the oil cooler 110. In this case, the lubricant oil can be rapidly and sufficiently cooled in the oil cooler 110. Thus, the cooling water circuit system can rapidly increase the temperature of the lubricant oil when the temperature of the lubricant oil is lower than the set temperature T(SET), and can rapidly and sufficiently cool the lubricant oil when the temperature of the lubricant oil is higher than the upper limit temperature T(UP) in the normal operation of the engine 10.

In this embodiment, the bypass passage 23, through which the cooling water from the heater water passage 30*a* and/or the cooling water from the radiator downstream passage 22 bypasses the oil cooler 110, is provided to be connected to the one opening portion of the four-way valve 120. Therefore, with a simple structure of the four-way valve 120, the cooling water from one of the heater water passage 30*a* and the radiator bypass passage 22 can be returned to the engine while bypassing the oil cooler 110, without decreasing an original flow amount of the cooling water in the heater water passage 30*a* or the radiator downstream passage 22.

When a solenoid type valve is used as the four-way valve 120, the cooling water from the heater water passage 30*a* to the oil cooler 110 and the cooling water from the radiator downstream passage 22 to the oil cooler 110 can be suitably mixed even when a mixing portion where the cooling water from the radiator downstream passage 22 and the cooling water from the heater water passage 30*a* are mixed is not provided upstream of the oil cooler 110.

(Second Embodiment)

Figure 4:
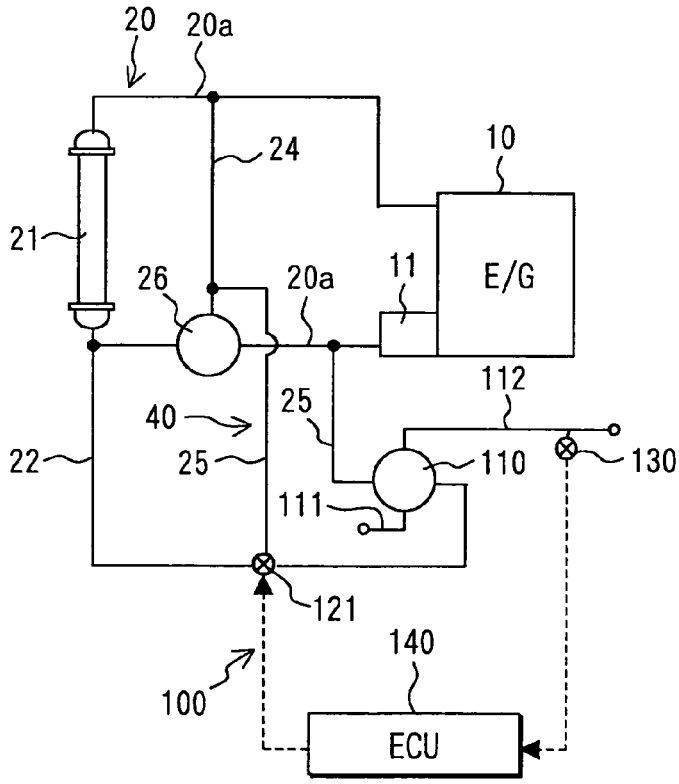
FIG. 4 is a schematic diagram of a cooling water circuit system, according to a second embodiment of the present invention.

The second embodiment of the present invention will be now described with reference to FIG. 4. In the second embodiment, a radiator main bypass passage 24, through which cooling water bypasses the radiator 21, is provided in a cooling water circuit system. Furthermore, a thermostat 26 is provided at a join portion where the radiator water passage 20*a* at a downstream side of the radiator 21 and the radiator main bypass passage 24 are joined.

A branch passage 25 branched from the radiator main bypass passage 24 is provided. Through the branch passage 25, refrigerant from the radiator main bypass passage 24 returns to the engine 10 after passing through the oil cooler 110. A branch bypass circuit 40 is constructed with the radiator main bypass passage 24 and the branch passage 25, so that refrigerant from the engine 10 returns to the engine 10 through the branch bypass circuit 40 while bypassing the radiator 21. The branch bypass circuit 40 is a radiator bypass passage of the present invention, through which refrigerant bypasses the radiator 21. In the second embodiment, the oil cooler 110 is disposed in the branch passage 25 of the branch bypass circuit 40.

A three-way valve 121 is provided to connect the radiator downstream passage 22 to an upstream side of the oil cooler 110, and to adjust a flow amount of the cooling water at a join portion where the radiator downstream passage 22 is jointed to the branch passage 25. Generally, the three-way valve 121 is provided at the join portion where the radiator downstream passage 22 is joined to the branch passage 25, so as to adjust a flow amount of cooling water from the radiator downstream passage 22 and a flow amount of cooling water from the radiator main bypass passage 24 to the branch passage 25.

According to the second embodiment, when the temperature of the lubricant oil after the engine starts is equal to or lower than the set temperature T(SET), the control unit 120 controls the three-way valve 121 so that the radiator downstream passage 22 is closed. In this case, the cooling water from the engine 10 flows through the oil cooler 110 through the radiator main bypass passage 24 and the branch passage 25, and returns to the engine 10. Accordingly, the temperature of the lubricant oil can be early increased.

When the temperature of the lubricant oil becomes higher than the upper limit temperature T(UP), the control unit 140 controls the three-way valve 121 to close a flow of cooling water from the radiator main bypass passage 24 to the branch passage 25. Accordingly, at least a part of cooling water after passing through the radiator 21 flows from the radiator downstream passage 22 to the oil cooler 110 through the branch passage 25. In this case, a temperature difference between the lubricant oil and the cooling water flowing in the oil cooler 110 can be made larger, and the lubricant oil can be effectively and sufficiently cooled.

According to the second embodiment, the oil cooler 110 is provided in the branch passage 25 branched from the radiator main bypass passage 24, and a flow of cooling water at the joint portion where the radiator downstream passage 22 is joined to the branch passage 25 is switched. Accordingly, similarly to the above-described first embodiment, the cooling water circuit system of the second embodiment can improve both the early heating effect of the lubricant oil when the temperature of the lubricant oil is lower than the set temperature T(SET), and the sufficient cooling effect of the lubricant oil when the temperature of the lubricant oil is higher than the upper limit temperature T(UP). Hear, the upper limit temperature T(UP) is higher than the set temperature T(SET) by a predetermined temperature.

Although the present invention has been fully described in connection with the preferred embodiments thereof with reference to the accompanying drawings, it is to be noted that various changes and modifications will become apparent to those skilled in the art.

Figure 5:
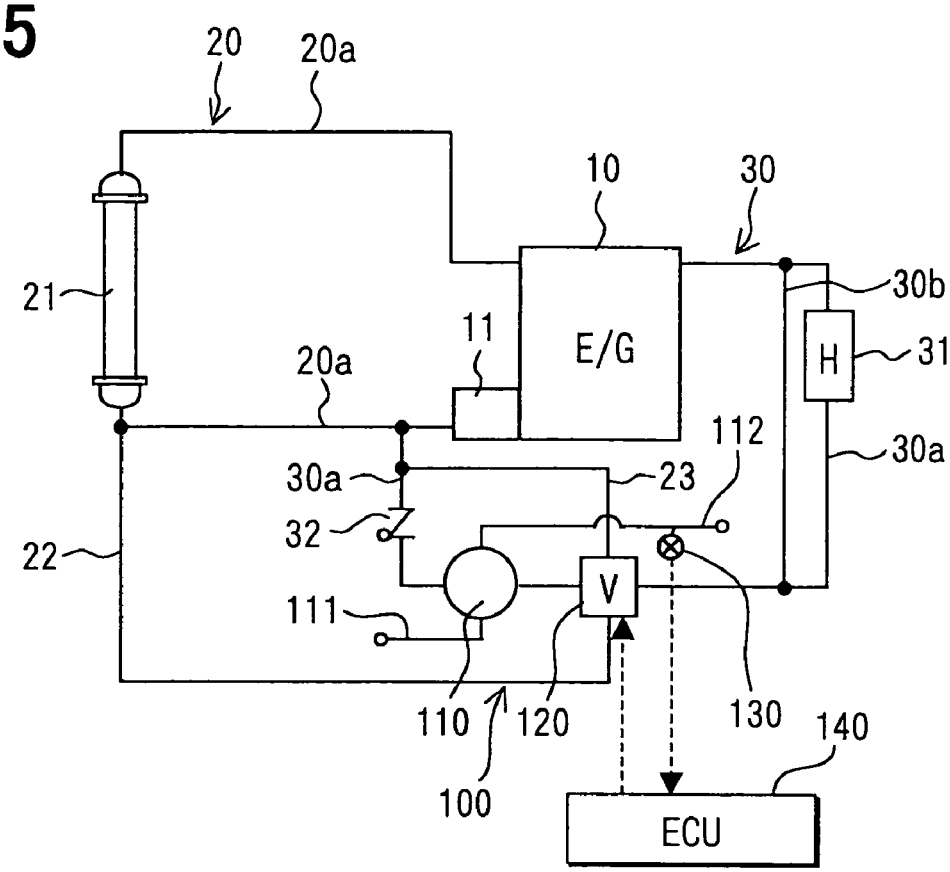
FIG. 5 is a schematic diagram of a cooling water circuit system, according to a modification of the first embodiment.

For example, in the above-described first embodiment of the present invention, the oil cooler 110 is provided in the heater water passage 30*a* (radiator bypass passage) so that cooling water from the heater core 31 can flow into the oil cooler through the heater water passage 30*a*. However, as shown in FIG. 5, a heater bypass passage 30*b* can be provided in the heater water circuit 30, and the oil cooler 110 can be provided so that cooling water from the heater bypass passage 30*b* flows into the oil cooler 110. Furthermore, an adjusting unit such as a valve or a switching unit can be provided at a join portion where the heater bypass passage 30*b* is joined to the heater water passage 30*a*, to adjust and switch a flow of cooling water flowing from the heater bypass passage 30*b*.

Such changes and modifications are to be understood as being within the scope of the present invention as defined by the appended claims.

What is claimed is:

1. A cooling water circuit system for an engine, comprising:

a radiator which cools cooling water of the engine;

a radiator water passage through which cooling water circulates between the radiator and the engine;

a radiator bypass passage through which the cooling water from the engine bypasses the radiator;

a heat exchanger disposed in the radiator bypass circuit to perform heat exchange between the cooling water and lubricant oil of an automatic transmission of the engine;

a radiator downstream passage through which the cooling water, after passing through the radiator and before passing into the engine, flows into the heat exchanger, the radiator downstream passage being connected to the radiator water passage at a downstream side of the radiator and an upstream side of the heat exchanger;

a flow adjusting unit disposed at a join portion where the radiator bypass passage and the radiator downstream passage are joined, to adjust a flow ratio of the cooling water flowing from the radiator downstream passage to the heat exchanger to the cooling water flowing from the radiator bypass passage to the heat exchanger;

a temperature detection unit which detects a temperature of the lubricant oil having passed through the heat exchanger; and a control unit which controls the flow adjusting unit in accordance with the temperature detected by the temperature detection unit.

2. The cooling water circuit system according to claim 1, further comprising a heat-exchanger bypass passage connected to the flow adjusting unit such that the cooling water from the flow adjusting unit bypasses the heat exchanger through the heat-exchanger bypass passage.

3. The cooling water circuit system according to claim 2, wherein the flow adjusting unit is a four-way valve.

4. The cooling water circuit system according to claim 3, wherein the four-way valve has a first opening portion connected to a downstream end side of the radiator downstream passage, a second opening portion connected to an upstream end side of the heat-exchanger bypass passage, and third and fourth opening portions connected to the radiator bypass passage at upstream and downstream sides of the four-way valve.

5. The cooling water circuit system according to claim 1, wherein the radiator bypass passage includes a heater water passage having therein a heater core which heats a fluid using the cooling water as a heating source.

6. The cooling water circuit system according to claim 5, wherein the radiator bypass passage further includes a heater-core bypass passage through which the cooling water bypasses the heater core.

7. The cooling water circuit system according to claim 1, wherein the radiator bypass passage includes a main bypass passage through which the cooling water bypasses the radiator, and a branch passage branched from the main bypass passage such that cooling water introduced from the main bypass passage to the branch passage returns to the engine after passing through the heat exchanger.

8. The cooling water circuit system according to claim 1, wherein the control unit controls the flow adjusting unit to decrease the flow ratio when the temperature detected by the temperature detection unit is lower than a set temperature after the engine starts.

9. The cooling water circuit system according to claim 8, wherein the control unit controls the flow adjusting unit to increase the flow ratio when the temperature detected by the temperature detection unit is higher than an upper limit temperature that is higher than the set temperature by a predetermined temperature.

10. The cooling water circuit system according to claim 1, wherein the control unit controls the flow adjusting unit to shut a flow of the cooling water from the radiator downstream passage to the heat exchanger when the temperature detected by the temperature detection unit is lower than a set temperature after the engine starts.

11. The cooling water circuit system according to claim 10, wherein the control unit controls the flow adjusting unit to shut a flow of the cooling water from the radiator bypass passage to the heat exchanger when the temperature detected by the temperature detection unit is higher than an upper limit temperature that is higher than the set temperature by a predetermined temperature.

* * * * *